US008483407B2

(12) United States Patent
Iwamatsu

(10) Patent No.: US 8,483,407 B2
(45) Date of Patent: Jul. 9, 2013

(54) NOISE REDUCING CIRCUIT

(75) Inventor: Masayuki Iwamatsu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 525 days.

(21) Appl. No.: 12/804,777

(22) Filed: Jul. 29, 2010

(65) Prior Publication Data

US 2011/0026735 A1 Feb. 3, 2011

(30) Foreign Application Priority Data

Jul. 31, 2009 (JP) ..... 2009-179854

(51) Int. Cl.
*H03G 5/00* (2006.01)
*H03G 3/00* (2006.01)
*H04B 15/00* (2006.01)

(52) U.S. Cl.
USPC ..... 381/101; 381/94.5; 381/109

(58) Field of Classification Search
USPC ..... 381/94.5, 109, 98, 101–103
See application file for complete search history.

(56) References Cited

U.S. PATENT DOCUMENTS

| | | | | |
|---|---|---|---|---|
| 4,859,955 | A | 8/1989 | Trethewey | |
| 6,295,364 | B1 * | 9/2001 | Finn et al. | 381/110 |
| 2006/0153403 | A1 * | 7/2006 | Lechner | 381/102 |

FOREIGN PATENT DOCUMENTS

| | | |
|---|---|---|
| JP | 4078208 | 12/1992 |
| JP | 7030497 | 1/1995 |
| JP | 2001203581 | 7/2001 |
| JP | 2007259324 | 10/2007 |

* cited by examiner

*Primary Examiner* — Ping Lee
(74) *Attorney, Agent, or Firm* — Pillsbury Winthrop Shaw Pittman LLP

(57) ABSTRACT

A noise reducing circuit includes a variable low-cut filter disposed at an upstream of a sound signal switching section and has a variable cutoff frequency, and a control circuit which controls the cutoff frequency of the variable low-cut filter to a first cutoff frequency lower than a cutoff frequency of a low-cut filter disposed at downstream of the variable low-cut filter when a switching instruction is not issued from a switching instructing section, and increases the cutoff frequency of the variable low-cut filter to a second cutoff frequency higher than the first cutoff frequency when the switching instruction is issued. The switching of the sound signal switching section is executed after a predetermined period elapses since the switching instruction is issued, and the control section decreases the cutoff frequency of the variable low-cut filter to the first cutoff frequency after the switching of the sound signal switching section is completed.

4 Claims, 7 Drawing Sheets

REPRODUCTION FREQUENCY RANGE OF SPEAKER (18)

FREQUENCY RANGE OF SOUND SIGNAL OF SOUND SOURCE (10)

FREQUENCY RANGE OF LOW-CUT FILTER (14)

FREQUENCY RANGE OF VARIABLE LOW-CUT FILTER (22) (WHEN SWITCHING IS NOT PERFORMED)

FREQUENCY RANGE OF VARIABLE LOW-CUT FILTER (22 ) (WHEN SWITCHING IS PERFORMED)

NOISE REDUCING CIRCUIT

BACKGROUND

The present invention relates to a noise reducing circuit applied to a sound reproducing system having a structure in which a sound signal such as music or the like is reproduced in an electroacoustic transducer via a sound signal switching circuit and then a low-cut filter (a low frequency bandstop filter) for cutting off a low frequency range of the sound signal, and is intended to reduce a noise which occurs characteristically due to switching of the sound signal switching circuit in the above structure.

In a sound reproducing system for reproducing sound such as music or the like using a small-sized speaker, when a sound signal including a low frequency range is supplied to the speaker, the low frequency range of the sound signal, which does not contributes to reproduction, causes a vibration plate of the speaker to operate with a large amplitude so that there are a potential to narrow the movable range of the vibration plate with respect to a range not less than a mid-frequency range which contributes to the reproduction, and a potential for the excessive amplitude of the vibration plate to cause a damage to the vibration plate and a drive signal line. Accordingly, in the sound reproducing system, the frequency range amplified by an amplifier is limited so as not to supply a signal with a frequency lower than a frequency that can be handled by a low frequency range reproducing ability of the speaker to the speaker. FIG. 2 shows a related sound reproducing system in which the low frequency range is limited. A sound signal supplied from a sound source 10 such as a storing/recording medium reproducing device, a television/radio tuner, or the like passes through a sound signal switching unit 12. After that, a frequency component of the sound signal lower than, e.g., 1 kHz which does not contributes to reproduced sound is removed at a low-cut filter 14. Then, the sound signal is amplified in a power amplifier 16 and reproduced in a speaker (electroacoustic transducer) 18. The sound signal switching unit 12 is, e.g., a sound source selector, a sound signal cutoff switch (a mute switch or the like), or a volume for changing volume of the sound signal stepwise, and performs switching of the sound signal (switching among source types, on/off switching of the sound, stepwise changing of the volume, or the like) using a switching instructing unit 20 such as a switching operation element (a source switching operation element, a mute operation element, a volume changing operation element, or the like) switched by an operator, or a switching instruction signal outputting unit which automatically outputs a switching instruction signal without depending on the switching operation by the operator. The low-cut filter 14 includes a capacitor C1 and a resistor R1.

[Patent Document 1] JP-A-2007-259324

[Patent Document 2] JP-A-2001-203581

[Patent Document 3] JP-A-7-30497

[Patent Document 4] JP-B-4-78208

In the sound reproducing system having the structure of FIG. 2, a voltage Vc at both ends of the capacitor C1 of the low-cut filter 14 fluctuates in accordance with the frequency and the amplitude of the sound signal supplied from the sound source 10. Specifically, with regard to the sound signal having the frequency of not more than a cutoff frequency of the low-cut filter 14, as the frequency of the sound signal decreases, the voltage Vc increases. FIG. 3 show voltage waveforms in a case where the sound signal switching unit 12 is switched and the sound signal is cut off by the sound signal switching unit 12 when the sound signal having the frequency of not more than the cutoff frequency of the low-cut filter 14 is supplied from the sound source 10. FIG. 3 shows the sound signal supplied from the sound source 10 and a potential (the voltage at both ends of the resistor R1) at a connection point P of the capacitor C1 and the resistor R1. When the sound signal is cut off by the sound signal switching unit 12, the voltage Vc at both ends of the capacitor C1 in applied to the resistor R1 so that the potential at the connection point P of the capacitor C1 and the resistor R1 is reduced to—Vc. Thereafter, a charge of the capacitor C1 is discharged via the resistor R1 so that the potential at the connection point P of the capacitor C1 and the resistor R1 returns to 0 V with a time constant of R1 and C1.

Thus, in the sound reproducing system of FIG. 2, when the sound signal switching unit 12 is switched, the charge charged in the low-cut filter 14 is discharged, and an undershoot thereby occurs in the potential at the connection point P of the capacitor C1 and the resistor R1. The frequency component of the undershoot portion is away from the sound signal supplied from the sound source 10 toward a higher-frequency range so that a noise sound (a petit noise) which is not included in the sound signal originally, makes a petit sound, and is easily audible to ears is caused to emit from the speaker 18.

The case where the sound signal switching unit 12 cuts off the sound signal is described in the above. In a case where the sound signal switching unit 12 changes the volume of the sound signal stepwise (step by step), the similar phenomenon occurs. Specifically, the noise sound which makes the petit sound continuously occurs while the volume is being changed. For example, in a cellular phone in which the cutoff frequency of the low-cut filter 14 is set to 1 kHz such that the sound signal of not more than 1 kHz can not be reproduced, when the sound signal of 100 Hz is supplied from the sound source 10, the sound signal is removed in the low-cut filter 14, and is not reproduced through the speaker 18. However, at this time, when the sound signal switching unit (volume adjustment) 12 for changing the volume stepwise is operated to adjust the volume, the stepwise changing of the volume causes stepwise changes in the potential at the connection point P of the capacitor C1 and the resistor R1, and the undershoot is caused to occur at the connection point P when each change is made. Because of this, while the volume is being adjusted, the petit noise of not less than 1 kHz is audible. As the related art for preventing the occurrence of the noise sound resulting from the switching of the sound signal, there have been technologies described in Patent Documents 1 to 4.

SUMMARY

The present invention has been achieved in view of the above-described situation, and the purpose of the present invention is to provide a noise reducing circuit for reducing a noise which occurs characteristically due to switching of a sound signal switching unit in a sound reproducing system having a structure in which a sound signal is reproduced in an electroacoustic transducer via the sound signal switching unit and then a low-cut filter for cutting off a low frequency range of the sound signal.

In order to achieve the above object, according to the present invention, there is provided a noise reducing circuit for a sound reproducing apparatus including a sound signal switching section which switches a sound signal so that a level difference appears in an output signal waveform of the sound signal, a low-cut filter which is disposed at a downstream of the sound signal switching section and has a cutoff frequency for cutting off a low frequency range of the sound signal, an electroacoustic transducer which outputs a sound based on the sound signal, and a switching instructing section which instructs switching of the sound signal switching section, the noise reducing circuit comprising:

a variable low-cut filter which is disposed at an upstream of the sound signal switching section and has a variable cutoff frequency; and a control circuit which controls the cutoff frequency of the variable low-cut filter to a first cutoff frequency being lower than the cutoff frequency of the low-cut filter when a switching instruction is not issued from the switching instructing section, and increases the cutoff frequency of the variable low-cut filter to a second cutoff frequency being higher than the first cutoff frequency when the switching instruction is issued from the switching instructing section, wherein the switching of the sound signal switching section is executed after a predetermined period elapses since the switching instruction is issued, and the control section decreases the cutoff frequency of the variable low-cut filter to the first cutoff frequency from the second cutoff frequency after the switching of the sound signal switching section is completed.

Preferably, the control circuit controls the cutoff frequency of the variable low-cut filter to the first cutoff frequency which allows to pass an entire frequency range of the sound signal, and the second cutoff frequency is substantially equal to the cutoff frequency of the low-cut filter.

Preferably, a change of the cutoff frequency of the variable low-cut filter is performed by changing a time constant of the variable low-cut filter while a capacitor is disposed in a sound signal path of the variable low-cut filter.

Preferably, the sound signal switching section is any one of a sound source selector, a sound signal cutoff switch, and a volume adjuster for changing volume of the sound signal stepwise.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
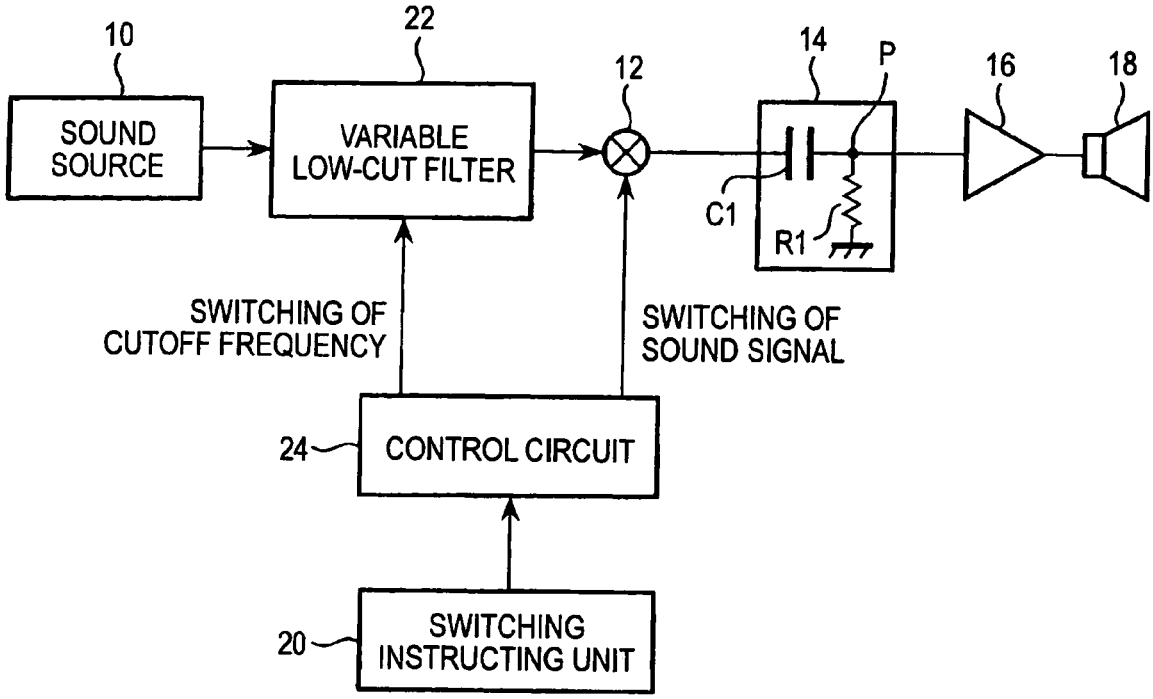
FIG. 1 is a block diagram of a sound reproducing system including a noise reducing circuit according to an embodiment of the present invention.
Figure 2:
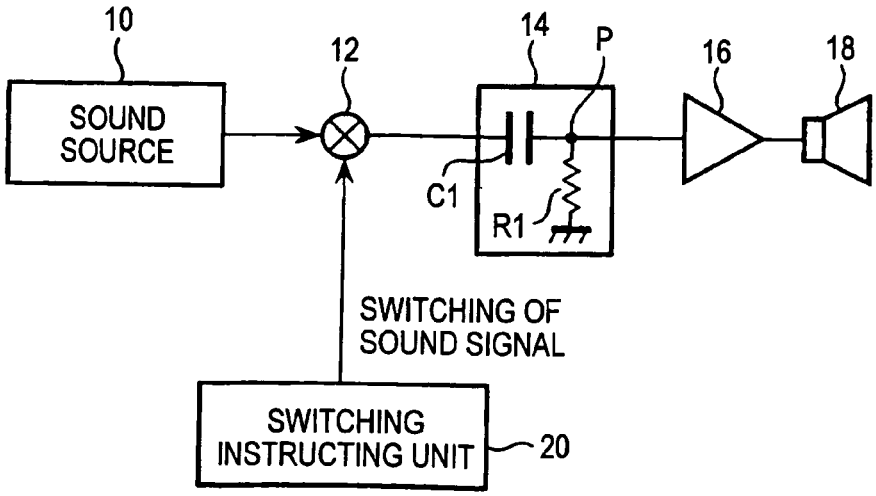
FIG. 2 is a block diagram showing a related sound reproducing system in which a low frequency range is limited.
Figure 3:
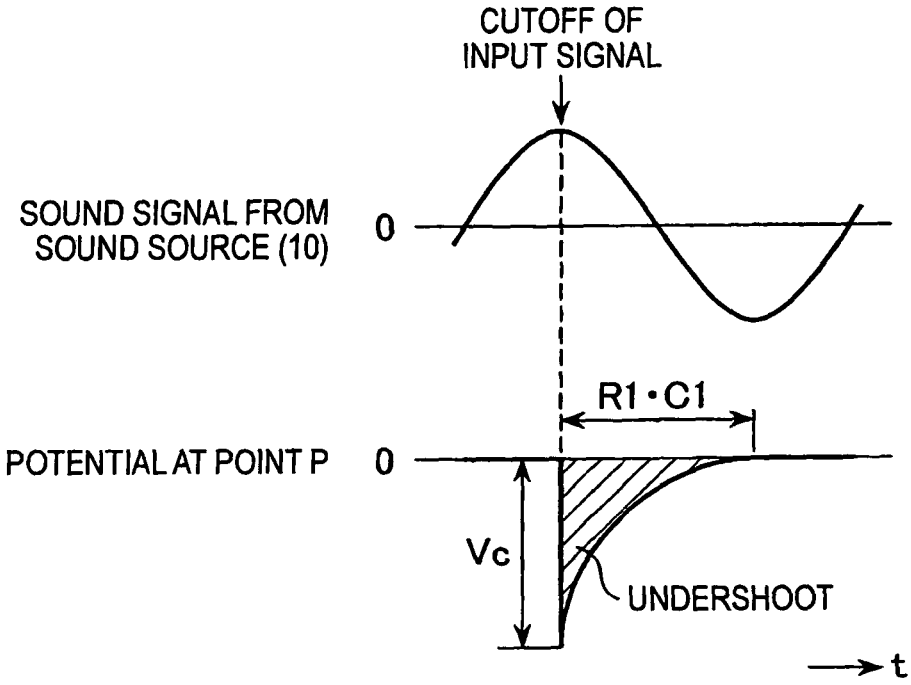
FIG. 3 is a waveform chart showing an operation when a sound signal switching unit is switched in the sound reproducing system of FIG. 2.

A noise reducing circuit according to an embodiment of the present invention is shown in FIG. 1. The configuration elements common to those in FIG. 2 are designated by identical reference numerals. A sound signal supplied from the sound source 10 such as a storing/recording medium reproducing device, a television/radio tuner, or the like passes through a variable low-cut filter (a variable high-pass filter) 22 and the sound signal switching unit 12. A frequency component of the sound signal, less than e.g., 1 kHz which does not contribute to a reproduced sound at a speaker (electroacoustic transducer) 18 is removed in the low-cut filter 14. After that, the sound signal is amplified in the power amplifier 16 and reproduced in the speaker 18. The variable low-cut filter 22 is a low-cut filter in which a cutoff frequency of the sound signal is variably controlled, and allows the sound signal supplied from the sound source 10 to pass therethrough with its passband on a low frequency range side variably controlled. The sound signal switching unit 12 is, e.g., a sound source selector, a sound signal cutoff switch (a mute switch or the like), or a volume for changing volume of the sound signal stepwise, and performs switching of the sound signal (switching among sources, on/off switching of the sound, stepwise changing of the volume, or the like). The low-cut filter 14 includes the capacitor C1 and the resistor R1. The switching instructing unit 20 is constituted as a switching operation element (a source switching operation element, a mute operation element, a volume changing operation element, or the like) switched by an operator, or a switching instruction signal outputting means for automatically outputting a switching instruction signal without depending on the switching operation by the operator. A control circuit 24 controls the switching of the sound signal switching unit 12 on the basis of a switching instruction from the switching instructing unit 20 to perform the switching of the sound signal. In addition, the control circuit 24 variably controls the cutoff frequency of the variable low-cut filter 22 on the basis of the switching instruction from the switching instructing unit 20.

Figure 4A:
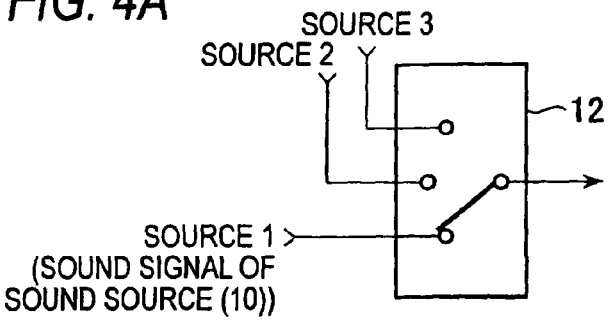
FIGS. 4A to 4C are circuit diagrams showing examples of a structure of the sound signal switching unit of FIG. 1.
Figure 4B:
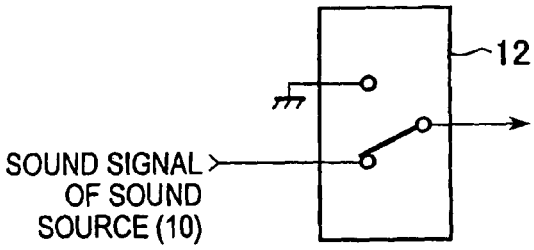
Figure 4C:
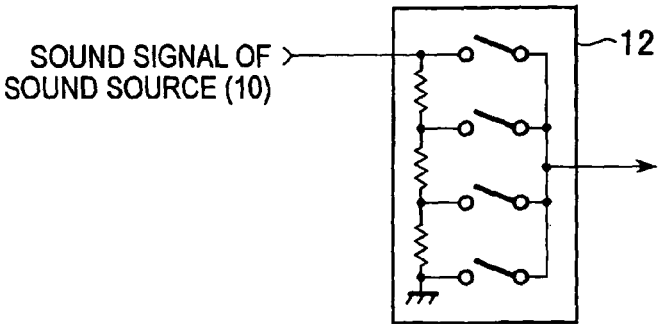

Examples of the structure of the sound signal switching unit 12 are shown in FIGS. 4A to 4C. The sound signal switching unit 12 in each of FIGS. 4A to 4C performs the switching of the sound signal by switching among sound signal paths. Specifically, the sound signal switching unit 12 of FIG. 4A constitutes the sound source selector. The sound signals from a plurality of sound sources are input to the sound source selector 12, and the sound signal from the single sound source selected by the source switching operation element or the like is selected and output with the switching control by the control circuit 24. In the signal path of each sound source, the variable low-cut filter 22 of the present invention is disposed at a position prior to the sound signal switching unit 12. In the variable low-cut filter in the signal path of each sound source (or in the variable low-cut filters of two sound sources before and after the switching), the cutoff frequency is temporarily reduced simultaneously during periods before and after the switching in the sound signal switching unit 12 is performed. The sound signal switching unit 12 of FIG. 4B constitutes the sound signal cutoff switch. The sound signal from the sound source 10 is input to the sound signal cutoff switch 12. In the sound signal cutoff switch 12, the sound signal is passed or cut off in accordance with the on/off operation of the mute operation element based on the switching control by the control circuit 24. The sound signal switching unit 12 of FIG. 4C constitutes an electronic volume for changing the volume of the sound signal stepwise. The sound signal from the sound source 10 is input to resistors in a plurality of stages constituting the electronic volume 12. In the electronic volume 12, the volume of the sound signal from the sound source 10 is changed stepwise by switching among the resistors in the plurality of stages using a switch (an analog switch) in accordance with the volume changing operation of the volume changing operation element or the like based on the switching control by the control circuit 24.

Figure 5:
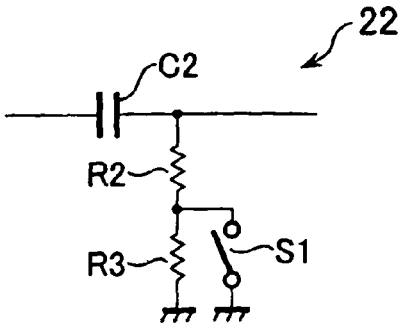
FIG. 5 is a circuit diagram showing an example of a structure of a variable low-cut filter of FIG. 1.

An example of the structure of the variable low-cut filter 22 is shown in FIG. 5. The variable low-cut filter 22 includes, e.g., a capacitor C2 and serially-connected resistors R2 and R3. The resistance values of the resistors R2 and R3 satisfy R2<R3 (e.g., R2: R3=1:100). A switch S1 is connected at both ends of the resistor R3 to short-circuit between the both ends of the resistor R3. The switch S1 is tuned on/off by the control circuit 24. When the switch S1 is turned off, the variable low-cut filter 22 becomes the low-cut filter including of the capacitor C2 and the resistors R2 and R3, and the cutoff frequency of the variable low-cut filter 22 is reduced. The cutoff frequency of the variable low-cut filter 22 can be set to, e.g., a value which allows the entire frequency range of the sound signal supplied form the sound source 10 to pass without limiting the frequency range of the sound signal (20 Hz to 20 kHz in the case of a CD-DA sound source). When the switching of the sound signal switching unit 12 is not performed, the variable low-cut filter 22 is held in this state. In contrast to this, when the switch S1 is turned on, the variable low-cut filter 22 becomes the low-cut filter including the capacitor C2 and the resistor R2, and the cutoff frequency of the variable low-cut filter 22 is increased. When the switching of the sound signal switching unit 12 is performed, the variable low-cut filter 22 is temporarily brought into this state (cutoff frequency is high state). When the cutoff frequency is changed, the capacitor C2 stays in the sound signal path so that a large undershoot due to the switching of the switch S1 does not occur, and the petit noise audible to ears does not newly occur.

Figure 6A:
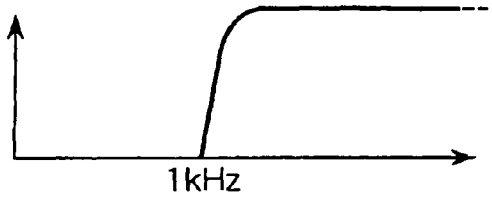
FIGS. 6A to 6E are characteristic views showing examples of a frequency range setting of the variable low-cut filter.
Figure 6B:
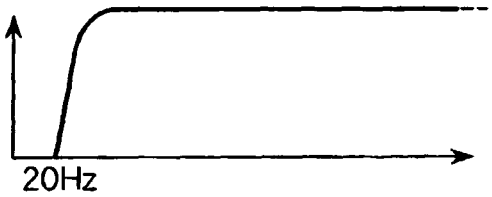
Figure 6C:
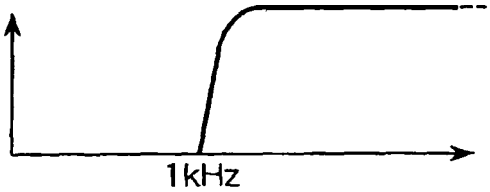
Figure 6D:
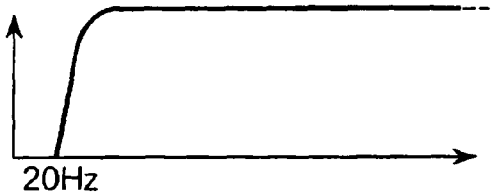
Figure 6E:
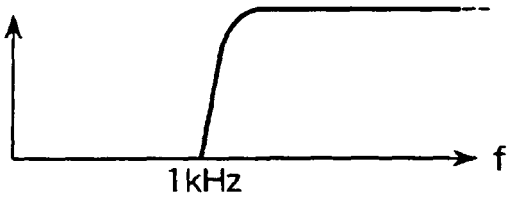

Examples of a frequency range setting of the variable low-cut filter 22 are shown in FIGS. 6A to 6E. FIG. 6A shows a reproduction frequency range of the speaker 18. For example, the entire sound reproducing system of FIG. 1 is mounted in a cellular phone, and the speaker 18 is small in size and capable of reproducing the frequency range of not less than 1 kHz. FIG. 6B shows a frequency range of the sound signal supplied from the sound source 10 which is of, e.g., 20 Hz to 20 kHz. FIG. 6C shows a passband of the low-cut filter 14 on a subsequent stage side. The passband is set to allow the frequency range of not less than 1 kHz to pass in correspondence to the reproduction frequency range of the speaker 18. FIG. 6D shows the passband of the variable low-cut filter 22 when the switch S1 is off. The passband is set to allow the frequency range of not less than 20 Hz (or a lower frequency) to pass such that the frequency range of the sound signal supplied from the sound source 10 can pass intact. FIG. 6E shows the passband of the variable low-cut filter 22 when the switch S1 is on. The passband is set to allow the frequency range of not less than 1 kHz to pass. In this setting, the low frequency range of the sound signal supplied from the sound source 10 is removed. The cutoff frequency of the variable low-cut filter 22 when the switch S1 is turned on does not need to be matched with the cutoff frequency of the low-cut filter 14 on the subsequent stage side precisely. The cutoff frequencies can be set in consideration of balance between a noise sound reduction effect and a change in tone when the switching is performed. For example, when both of the cutoff frequencies are set to be substantially equal to each other, it is possible to reduce the change in tone when the switching is performed while securing the noise sound reduction effect.

Figure 7:
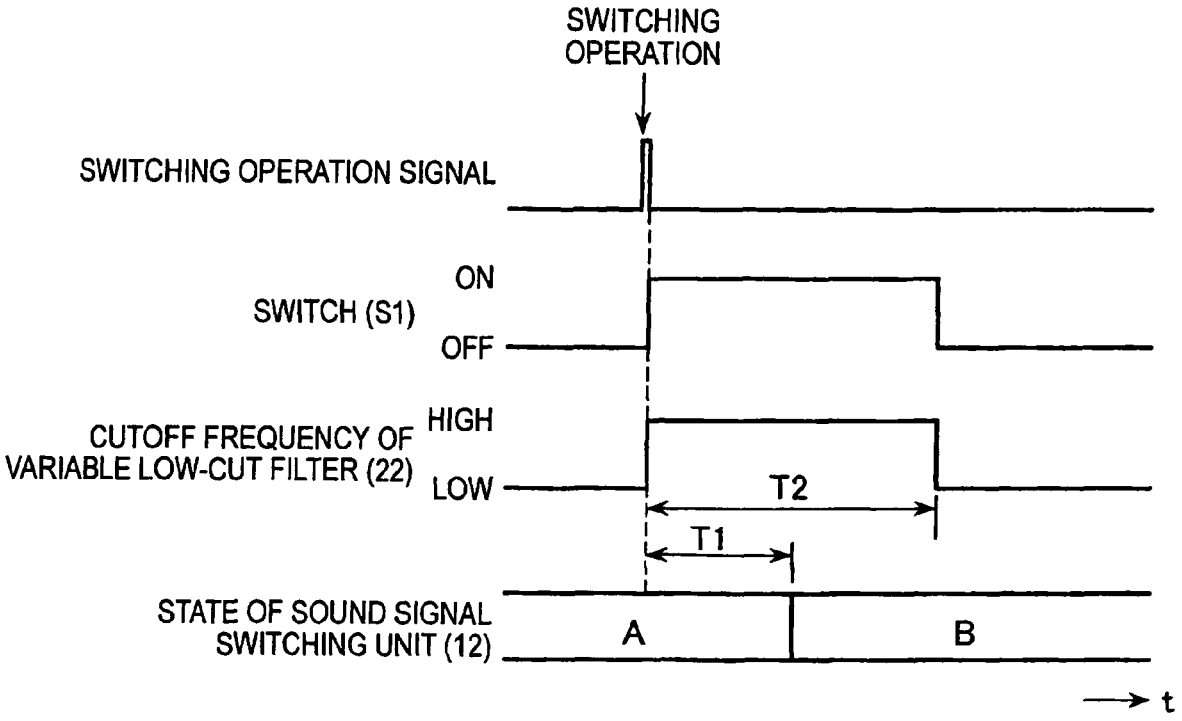
FIG. 7 is a timing chart showing an operation when a switching operation of the sound signal switching unit of FIG. 1 is performed.

Next, a description will be given of variable control of the cutoff frequency of the variable low-cut filter 22, and the switching control of the sound signal switching unit 12 by the control circuit 24. FIG. 7 shows an operation when the switching of the sound signal switching unit 12 is instructed with the switching operation in the switching instructing unit 20. Before the switching instructing unit 20 is operated, the switch S1 is turned off, and the cutoff frequency of the variable low-cut filter 22 is set to the low frequency. Accordingly, the sound signal supplied from the sound source 10 passes through the sound signal switching unit 12 with its frequency range remaining intact (with no limitation to the frequency range). The switching state of the sound signal switching unit 12 at this time is assumed to be a state A. When the switching instructing unit 20 is switched, and the switching instruction signal is thereby output from the switching instructing unit 20, the switch S1 is immediately turned on, and the cutoff frequency of the variable low-cut filter 22 is shifted up to a high frequency. With this operation, the voltage Vc at both ends of the capacitor C1 of the low-cut filter 14 on the subsequent stage side is reduced to be in the vicinity of 0 V. Then, after a lapse of a given time period T1 since the switching operation, the state of the sound signal switching unit 12 is switched from the state A to a state B based on the operation content of the switching instructing unit 20. At this time, since the voltage Vc at both ends of the capacitor C1 is reduced to be in the vicinity of 0 V, even when the sound signal switching unit 12 is switched, the potential at the connection point P of the capacitor C1 and the resistor R1 of the low-cut filter 14 is not significantly changed and, accordingly, a large undershoot does not occurs at the connection point P. Consequently, the petit noise audible to ears does not occur. The time period T1 can be set to, e.g., a time period longer than a time constant of the low-cut filter 14 on the subsequent stage side. Thereafter, when a given time period T2 since the turning-on of the switch S1 elapses (timing after the switching of the sound signal switching unit 12 is completed), the switch S1 is turned off, and the cutoff frequency of the variable low-cut filter 22 is shifted down to the original low frequency. With this operation, the sound signal after the switching passes through the sound signal switching unit 12 while retaining the frequency range supplied from the sound source 10.

Figure 8:
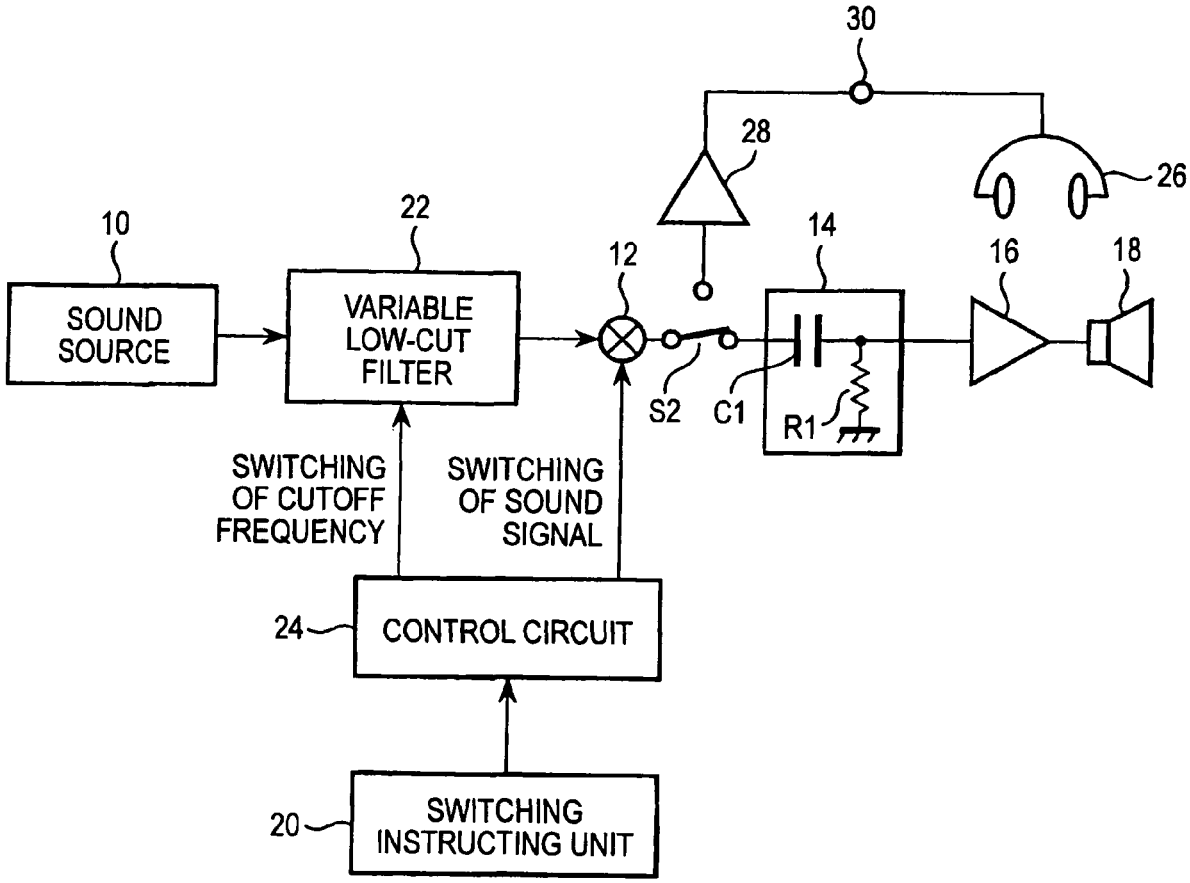
FIG. 8 is a block diagram of another example of a sound reproducing system including the noise reducing circuit according to the embodiment of the present invention.

A block diagram of another example of a sound reproducing system including the noise reducing circuit according to an embodiment of the present invention is shown in FIG. 8. This sound reproducing system is adapted to be capable of switching between the reproduction using the speaker 18 and the reproduction using headphones 26 by disposing a switch S2 between the sound signal switching unit 12 and the low-cut filter 14 on the subsequent stage side in the sound reproducing system of FIG. 1. The switch S2 is switched by the switching operation of a user. When the reproduction is performed using the headphones 26, the sound signal output from the sound signal switching unit 12 is amplified in a headphone amplifier 28 via the switch S2, and supplied to and reproduced in the headphones 26 via a headphone jack 30. Since the reproduction frequency range of the headphones 26 covers so as to extend to the low frequency range, a low-cut filter corresponding to the low-cut filter 14 disposed in the reproduction signal path of the speaker 18 is not disposed in the reproduction signal path of the headphones 26. Accordingly, even when the switching of the sound signal is performed in the sound signal switching unit 12, the undershoot does not occur in the sound signal, and the petit noise audible to ears does not occur. The sound signal supplied from the sound source 10 is reproduced in the headphones 26 with no limitation on the frequency range. When the reproduction is performed using the headphones 26, even in a case where the switching of the sound signal is performed in the sound signal switching unit 12, and the cutoff frequency of the variable low-cut filter 22 is temporarily shifted up to the higher cutoff frequency, the cutoff frequency is immediately shifted down to the original frequency when the switching of the sound signal is completed so that Hi-Fi reproduction is maintained.

Figure 9:
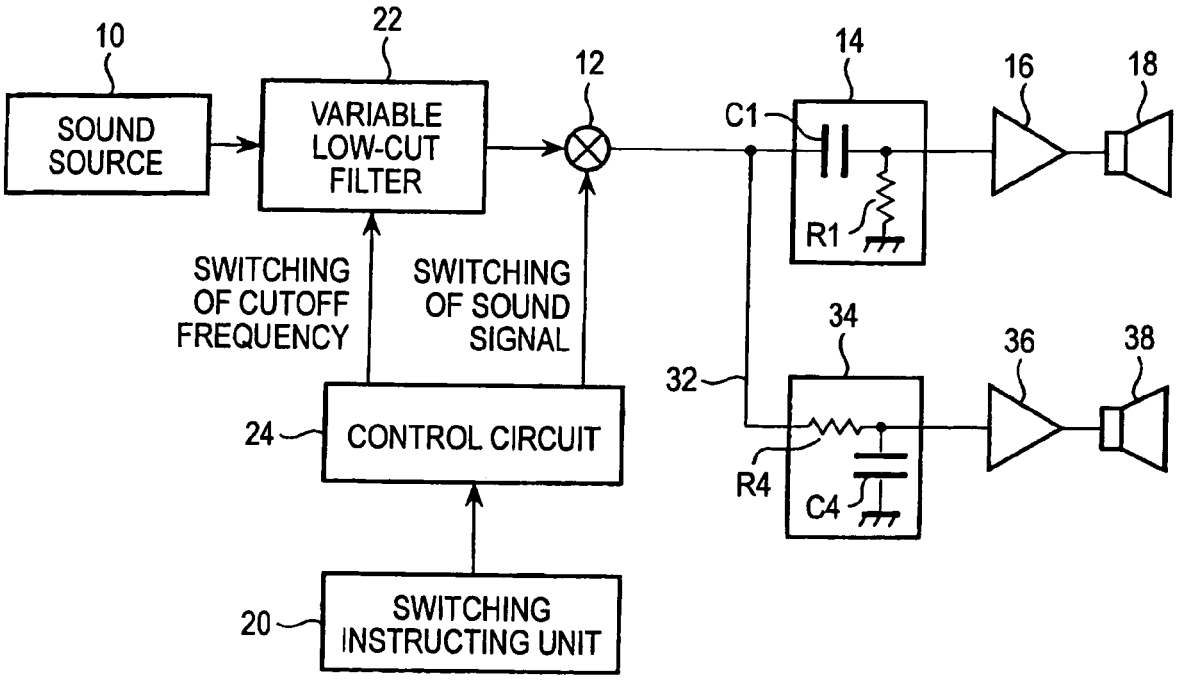
FIG. 9 is a block diagram of another example of a sound reproducing system including the noise reducing circuit according to the embodiment of the present invention.

A block diagram of another example of a sound reproducing system including the noise reducing circuit according to an embodiment of the present invention is shown in FIG. 9. This sound reproducing system constitutes a two-way speaker system by using the speaker 18 of FIG. 1 as a tweeter and adding a woofer thereto. A signal path 32 is branched from a point between the sound signal switching unit 12 and the low-cut filter 14 (a high-pass filter) on the subsequent stage side. With regard to the sound signal supplied to the signal line 32, the low frequency component of the sound signal is extracted in a low-pass filter 34 including a resistor R4 and a capacitor C4, amplified in a power amplifier 36, and reproduced in a woofer 38. The minimum frequency range of the passband of the low-cut filter 14 and the maximum frequency range of the reproduction frequency range of the low-pass filter 34 cross over each other. The low-pass filter 34 is disposed in the reproduction signal path of the woofer 38 so that the petit noise does not occur even when the switching of the sound signal is performed in the sound signal switching unit 12. In addition, even when the switching of the sound signal is performed in the sound signal switching unit 12, and the cutoff frequency of the variable low-cut filter 22 is temporarily shifted up, the cutoff frequency is immediately shifted down to the original frequency when the switching of the sound signal is completed, and the low frequency component included in the original sound supplied from the sound source 10 is supplied to the reproduction signal path of the woofer 38 intact so that the Hi-Fi reproduction is maintained.

In the above-described embodiment, the cutoff frequency of the variable low-cut filter 22 is switched between two stages in the frequency, one is the low frequency which is constantly used when the switching of the sound signal is not performed and the other is the high frequency which is temporarily used when the switching of the sound signal is performed. However, it is possible to increase the number of stages. For example, it is possible to perform the switching of the cutoff frequencies in which the cutoff frequency of 0 Hz (i.e., the cutoff frequency that allows the sound signal to pass intact) is prepared in addition to the above-mentioned cutoff frequencies in high and low stages, the cutoff frequency is held at 0 Hz when the switching of the sound signal is not performed, the cutoff frequency is changed to the high cutoff frequency via the low (intermediate) cutoff frequency when the switching of the sound signal is performed, and the high cutoff frequency is reduced back to the cutoff frequency of 0 Hz via the low (intermediate) cutoff frequency when the switching of the sound signal is completed.

In the above-described embodiment, the variable low-cut filter 22 is constituted by an analog filter. However, when the variable low-cut filter 22 is disposed in the sound reproducing system constituted by a digital circuit, the variable low-cut filter 22 can be constituted by a digital filter. In addition, in the above-described embodiment, the variable low-cut filter 22 is provided only for the use of the present invention. However, when it is necessary to dispose a filter at the corresponding position for another use, it is possible to use the filter for both uses and, when the switching of the sound signal is performed, it is possible to use the filter by temporarily changing characteristics of the filter for the use of the present invention.

The sound reproducing system shown in the above-described embodiment can be constituted by being incorporated in one device, and can also be divided and constituted in a plurality of devices. When the sound reproducing system is divided and constituted, for example, in the sound reproducing system of FIG. 1, it is possible to incorporate the portion from the sound source 10 to the sound signal switching unit 12 into one device, incorporate the portion from the low-cut filter 14 to the speaker 18 into another device, and use both devices by connecting the devices with each other using a signal cable.

The above embodiments are summarized as follows.

The present invention is a noise reducing circuit applied to a sound reproducing apparatus including a circuit for supplying a sound signal to an electroacoustic transducer via a sound signal switching section which switches the sound signal so that a level difference appears in an output signal waveform of the sound signal with a signal switching operation, and then a low-cut filter for cuffing off a low frequency range of the sound signal, and a switching instructing section for instructing switching of the sound signal switching section. The noise reducing circuit includes a variable low-cut filter having a variable cutoff frequency which is disposed at a stage prior to the sound signal switching section, and a control circuit which executes control of reducing the cutoff frequency of the variable low-cut filter to be lower than the cutoff frequency of the low-cut filter disposed at a stage subsequent to the variable low-cut filter (hereinbelow, occasionally referred to as a "low-cut filter on a subsequent stage side") when a switching instruction is not issued from the switching instructing section (including a case where the cutoff frequency is set to 0 Hz (in other words, the function as the low-cut filter is stopped) to allow the entire frequency range to pass), increasing, when the switching instruction is issued, the cutoff frequency of the variable low-cut filter to a value higher than the value when the switching instruction is not issued, then executing the switching of the sound signal switching section in accordance with the switching instruction, and bringing the cutoff frequency of the variable low-cut filter back into a state before the issuing of the switching instruction after the switching of the sound signal switching section is completed. When the switching instruction is issued from the switching instructing section, since a low frequency component of an input signal to the sound signal switching section is attenuated in the variable low-cut filter before the sound signal switching section is switched, a voltage at both ends of a capacitor of the low-cut filter on the subsequent stage side is reduced to a low value. Consequently, when the sound signal switching section is switched, an undershoot or an overshoot becomes less likely to occur so that the occurrence of a noise sound is suppressed. It is possible to set the cutoff frequency of the variable low-cut filter to a value which allows the entire frequency range of the sound signal to pass when, e.g., the switching instruction is not issued from the switching instructing section, and to a value approximate to the cutoff frequency of the low-cut filter on the subsequent stage side when the switching instruction is issued.

Preferably, it is possible to perform a change of the cutoff frequency of the variable low-cut filter by, e.g., changing a time constant of the variable low-cut filter while a capacitor is inserted in a sound signal path of the variable low-cut filter. Also, it is possible to prevent the occurrence of a sharp level difference in the output signal waveform of the variable low-cut filter, and suppress the occurrence of a new noise in the low-cut filter on the subsequent stage side due to the change of the passband of the variable low-cut filter.

Preferably, the sound signal switching section may be any one of a sound source selector, a sound signal cutoff switch, and a volume adjuster for changing volume of the sound signal stepwise. The switching instructing section may be, e.g., an operation element switched by an operator. The control circuit may be, e.g., a circuit which controls the frequency range of the cutoff frequency of the variable low-cut filter when the switching instruction is issued so as to be substantially equal to that of the cutoff frequency of the low-cut filter on the subsequent stage side. When the sound reproducing apparatus is a sound reproducing apparatus which is mounted in a cellular phone, and limits the passband for the sound signal on the low frequency range side to the frequency range of substantially not less than 1 kHz using the low-cut filter on the subsequent stage side to emit the sound from a small-sized speaker constituting the electroacoustic transducer mounted in the cellular phone, the control circuit may be a circuit which sets the cutoff frequency of the variable low-cut filter when the switching instruction is issued to substantially 1 kHz.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-179854 filed on Jul. 31, 2009, the contents of which are incorporated herein by reference.

What is claimed is:

1. A noise reducing circuit for a sound reproducing apparatus including a sound signal switching section which switches a sound signal so that a level difference appears in an output signal waveform of the sound signal, a low-cut filter which is disposed at a downstream of the sound signal switching section and has a cutoff frequency for cutting off a low frequency range of the sound signal, an electroacoustic transducer which outputs a sound based on the sound signal, and a switching instructing section which instructs switching of the sound signal switching section, the noise reducing circuit comprising:

a variable low-cut filter which is disposed at an upstream of the sound signal switching section and has a variable cutoff frequency; and a control circuit which controls the cutoff frequency of the variable low-cut filter to a first cutoff frequency being lower than the cutoff frequency of the low-cut filter when a switching instruction is not issued from the switching instructing section, and increases the cutoff frequency of the variable low-cut filter to a second cutoff frequency being higher than the first cutoff frequency when the switching instruction is issued from the switching instructing section, wherein the switching of the sound signal switching section is executed after a predetermined period elapses since the switching instruction is issued, and the control section decreases the cutoff frequency of the variable low-cut filter to the first cutoff frequency from the second cutoff frequency after the switching of the sound signal switching section is completed.

2. The noise reducing circuit according to claim 1, wherein the control circuit controls the cutoff frequency of the variable low-cut filter to the first cutoff frequency which allows to pass an entire frequency range of the sound signal; and wherein the second cutoff frequency is substantially equal to the cutoff frequency of the low-cut filter.

3. The noise reducing circuit according to claim 1, wherein a change of the cutoff frequency of the variable low-cut filter is performed by changing a time constant of the variable low-cut filter while a capacitor is disposed in a sound signal path of the variable low-cut filter.

4. The noise reducing circuit according to claim 1, wherein the sound signal switching section is any one of a sound source selector, a sound signal cutoff switch, and a volume adjuster for changing volume of the sound signal stepwise.

* * * * *